US011491065B2

(12) United States Patent
Tomczak

(10) Patent No.: US 11,491,065 B2
(45) Date of Patent: Nov. 8, 2022

(54) STANDING AID FOR HELPING A PERSON STAND UP

(71) Applicant: BEKA HOSPITEC GMBH, Wetzlar (DE)

(72) Inventor: Matthias Tomczak, Frankfurt am Main (DE)

(73) Assignee: BEKA HOSPITEC GMBH

( * ) Notice: Subject to any disclaimer, the term of this patent is extended or adjusted under 35 U.S.C. 154(b) by 75 days.

(21) Appl. No.: 16/720,716

(22) Filed: Dec. 19, 2019

(65) Prior Publication Data

US 2020/0206053 A1 Jul. 2, 2020

(30) Foreign Application Priority Data

Dec. 20, 2018 (DE) ..... 102018133234.3

(51) Int. Cl.
*A61G 7/10* (2006.01)

(52) U.S. Cl.
CPC ..... *A61G 7/1019* (2013.01); *A61G 7/1046* (2013.01); *A61G 7/1059* (2013.01); *A61G 2200/34* (2013.01)

(58) Field of Classification Search
CPC .. A61G 7/1019; A61G 7/1046; A61G 7/1059; A61G 7/1017; A61G 7/1096; A61G 2200/34; A61G 2200/36; A47C 7/506
See application file for complete search history.

(56) References Cited

U.S. PATENT DOCUMENTS

| | | | | |
|---|---|---|---|---|
| 4,101,163 | A * | 7/1978 | Morin | A47C 9/10 248/155.5 |
| 7,647,655 | B2 | 1/2010 | Liljedahl | |
| 9,775,451 | B1 * | 10/2017 | Chon | A47G 9/10 |
| 2009/0165204 | A1 * | 7/2009 | Biersteker | A61G 7/1096 5/87.1 |
| 2011/0056019 | A1 | 3/2011 | Altena et al. | |

(Continued)

FOREIGN PATENT DOCUMENTS

| | | | | |
|---|---|---|---|---|
| DE | 20303002 | U1 | 6/2003 | |
| WO | WO-9611658 | A1 * | 4/1996 | A61G 5/14 |
| WO | 2011151639 | A1 | 12/2011 | |

OTHER PUBLICATIONS

Foreign communication from a related counterpart application—Office Action of German Patent Application No. 10 2018 133 234.3, dated Oct. 24, 2019, 7 pages.

(Continued)

*Primary Examiner* — David R Hare
*Assistant Examiner* — Alison N Labarge
(74) *Attorney, Agent, or Firm* — Klemchuk LLP

(57) ABSTRACT

A standing aid for helping a person stand up is proposed, having a frame, at least one support arm arranged movably on the frame and with handles, and a drive device coupled to the frame and to the at least one support arm in order to move the at least one support arm to a lowered and to a raised position, and having at least one padded rest configured to support the shins of the person during the movement of the at least one support arm. The padded rest is formed from a viscoelastic foam with a thickness of at least 6 cm and is dimensioned in such a way that the person's kneecaps at all times bear on the padded rest during the movement of the support arm.

12 Claims, 2 Drawing Sheets

(56) References Cited

U.S. PATENT DOCUMENTS

| | | | | |
|---|---|---|---|---|
| 2011/0083266 | A1* | 4/2011 | Herron | A61G 7/1017 5/83.1 |
| 2014/0215720 | A1* | 8/2014 | Escobar Uribe | A47C 27/15 5/654 |
| 2017/0333745 | A1 | 11/2017 | Tekulve | |
| 2018/0036189 | A1* | 2/2018 | Lingegard | A61G 7/1092 |
| 2019/0247256 | A1* | 8/2019 | Huang | A61G 7/1046 |

OTHER PUBLICATIONS

Foreign Communication from a related application—Extended European Search Report of European Patent Application No. 192 17 746.7, dated May 12, 2020.

* cited by examiner

STANDING AID FOR HELPING A PERSON STAND UP

CROSS-REFERENCE TO RELATED APPLICATIONS

This application claims priority to German Patent Application No. 10 2018 113 234.3 filed Dec. 20, 2018, which is incorporated by reference herein in its entirety.

FIELD OF INVENTION

The present disclosure relates to a standing aid for helping a person to stand up.

BACKGROUND

A standing aid usually has a frame with a handle which the person in question can grip. The frame stands with a base, which is preferably equipped with castors, on the floor. The handle is arranged on a pivotably mounted support arm, which is movable by a drive between a lowered and a raised position. The standing aid is moved for example towards a bed, a chair or a wheelchair on which the person in question is sitting. The feet are then placed onto a rest connected to the frame, and the support arm is lowered. The shins of the person seeking to stand up are placed on shin cushions, which are connected to the frame, and the handle is gripped firmly. The shin cushions are arranged adjustably on a lower region of the frame and serve as a counter-bearing when the support arm is moved to the raised position. While this is happening, the person's shins are supported on the shin cushions and the person follows the upwardly directed movement of the support arm. Additionally or alternatively to the movable support arm, it is also possible for belts, straps or slings to be present for raising the back and/or the buttocks. It is known to couple these in particular to the support arm.

An example of a standing aid is disclosed in WO 2014 154 661 A1.

A disadvantage of the known standing aids is that the shin cushions have to be adapted with some difficulty to the particular person in order to ensure that, during the standing-up movement, there is no feeling of excess pressure or even a pressure point on the shins. This is usually done by loosening or releasing the shin cushions and searching for a suitable position within a predefined vertical framework until the person is able to place their shins very comfortably on the shin cushions. An important aspect is to ensure that the person's kneecaps do not come into contact with the shin rest, since this could cause the person pain during the standing-up movement. The entire procedure is thus time-consuming and laborious, both for the person seeking to stand up and for the caregiver.

SUMMARY

The aim of this disclosure is to overcome these and further disadvantages of the prior art and to propose an alternative standing aid with which the abovementioned disadvantages can be remedied, such that complicated adjustment of the shin cushions is unnecessary and yet a comfortable upright movement can be ensured.

A standing aid for helping a person stand up is proposed, having a frame, at least one support arm arranged movably on the frame with handles, and a drive device coupled to the frame and to the at least one support arm in order to move the at least one support arm to a lowered and to a raised position, and having at least one padded rest for supporting the shins of the person during the movement of the at least one support arm. The padded rest is formed from a viscoelastic foam with a thickness of at least 6 cm and is dimensioned in such a way that the person's kneecaps at all times bear on the padded rest during the movement of the support arm.

The frame can have a base which, as is customary in the prior art, can be equipped with castors. In this way, the standing aid can be moved conveniently across a floor and can be used flexibly in different rooms. The frame can also have a vertical portion extending upwards from the base.

The support arm can be formed in one part or several parts and/or can be arranged on the vertical portion of the frame in such a way as to be pivotable about an in particular horizontal pivot axis. For holding on, at least one handle is provided, which is arranged on the support arm. It is conceivable for several differently shaped and disposed handles to be used, which are adapted to specific habits, preferences or physical limitations.

In order to support the feet, the frame can have a foot rest. The latter can prevent the frame from accidentally moving away from the person during the standing-up movement. The foot rest can be arranged in a fixed, non-adjustable position.

The padded rest is arranged near the base and extends vertically well above the foot rest. It is formed from a viscoelastic foam having a thickness of at least 6 cm.

This design of a standing aid with a padded rest formed from a viscoelastic foam makes it possible for the first time to help a person, in particular a patient, to stand up in an uncomplicated and substantially painless way.

In contrast to the solutions known from the prior art, the viscoelastic foam is able to reproduce the anatomy of the patient and in doing so can take up not only the shins of the person seeking to stand up, but also the knees.

The mechanical deformation behaviour of a viscoelastic foam differs significantly from that of a cold-cure foam. The material behaviour is both elastic and viscous, such that the foam combines the properties of solids and liquids. This material is also known as "memory foam" and can be based mainly on polyurethanes for example. Such a foam is much denser than a conventional foam and can exert an improved supporting force. The deformation behaviour can also be adapted in such a way that, in a smooth and relatively slow movement with only a slow change of the mechanical pressure, the foam adapts very easily to the shape of the person's shins and knees. However, in the event of a more rapid change of the mechanical pressure, a sufficient supporting force can be made available, since the foam does not change its shape directly. The padded rest thus forms an optimally adapted counter-bearing for the standing-up movement. By virtue of the good shape adaptation, the use of such a foam can permit an ideal distribution of the mechanical pressure, such that the load on the knees is barely noticeable.

A particular advantage of the standing aid according to this disclosure is that the fastening position of the padded rest does not have to be adapted laboriously to the particular user, and instead the positive properties of the viscoelastic foam allow the padded rest to be optimally adapted to any persons without manual interaction. For this purpose, it is expedient that the foam has a sufficient material thickness. It has been found that a thickness of approximately 5 cm or 6 cm is sufficient to ensure such adaptation. The padded rest can additionally be dimensioned in at least the vertical direction in such a way that, for practically all conceivable body sizes of persons, support is provided for the entire shin and knee, and no readjustment of the padded rest is necessary.

In embodiments, the foam has a thickness of 7 to 13 cm, alternatively a thickness of approximately 9 to 11 cm, alternatively, a thickness of approximately 10 cm. Accordingly, the foam can help the shin or knee sink in gently and can ensure that there is no risk of hitting a mechanical limit of the foam at a side directed towards the frame.

According to embodiments, the padded rest can have, on a rear side, a pivotable bearing, which is connected to the frame. In this way, the entire padded rest can be tilted about the pivotable bearing. During the standing-up movement, the padded rest can therefore follow a modified orientation of the shins and knees of the person, so as to avoid a mechanical pressure increasing only locally between the padded rest and the person. The padded rest therefore performs a compensating movement, which reduces still further the load placed on the person. It is conceivable that, by using a pivotable bearing on the padded rest, the latter can also be equipped with a relatively small thickness of the viscoelastic foam layer, which thickness can for example be at the lower end of the range indicated above.

In embodiments, the bearing can have at least one horizontal hinge axis. The latter is oriented parallel to the floor during the intended use of the standing aid. The hinge axis can be additionally arranged symmetrically with respect to the frame. The padded rest can therefore perform a tilting movement about an axis that runs parallel to an imaginary connecting line between the two knees of the person in question.

In embodiments, the bearing is arranged substantially centrally on the padded rest. In particular, the bearing can be arranged at the geometric centre of a rear side of the padded rest and if necessary can be offset slightly in the vertical direction. In this way, the padded rest can be very easily aligned with the shins of a seated person and can exert a sufficient supporting force at all the shin angles that occur during the standing-up movement.

In embodiments, the padded rest can have, on a rear side, a fixed shell on which the foam is arranged. The shell could be made of a metallic material, for example aluminium, or a plastic, for example polycarbonate (PC), polypropylene (PP), acrylonitrile butadiene styrene (ABS) or a fibre-reinforced plastic. The fixed shell serves in particular as a carrier for the viscoelastic foam and for coupling the padded rest to the frame. Therefore, the padded rest can have the soft foam exclusively on a side directed towards the person seeking to stand up, if the fixed shell is present on the rear side. It is thus possible to rule out a situation in which, as the shins and knees begin to nestle into the padded rest, there is brief contact with a hard border around the foam, which makes standing up unpleasant.

In embodiments, a base layer made of a cold-cure foam can be arranged between the foam and the fixed shell. The base layer can prevent the viscoelastic foam from being pressed through as far as the fixed shell. The cold-cure foam can have a conventional, exclusively elastic behaviour through use of an open-pore foam. In particular, the cold-cure foam can have a relatively high strength, which influences as little as possible the mechanical behaviour of the viscoelastic foam.

It is advantageous if the base layer has a thickness which corresponds to at most one quarter of the thickness of the foam, alternatively at most one eighth. Therefore, the contribution of the base layer to an overall thickness of the padded rest is negligible. A thickness of the base layer of approximately 1 cm is conceivable.

In embodiments, the padded rest has a flexible, watertight protective layer. This protective layer could be designed as a lamination or foam lining. The protective layer can be based on polyurethane or have polyurethane. If a fixed shell is used for the padded rest, the protective layer can surround the fixed shell including the viscoelastic foam. This ensures non-sensitivity to water and to mechanical and chemical actions, for example during transport or during disinfection.

In embodiments, the padded rest can extend to a height of at least 65 cm or at least 70 cm relative to a foot rest. This could cover almost all sizes of persons seeking to stand up, for example at least 95 percent. However, compared to conventional standing aids, there would be sufficient space above the padded rest in order to lengthen the padded rest still further. In known standing aids, this space is available to accommodate pads only when so required, if the shin cushions have been adjusted to a vertically upper position. However, since contact with the knees is to be excluded there, the shin supports are also only moved into this space when so required. In the standing aid according to the disclosure, however, the padded rest can be lengthened upwards in such a way that all persons of any size can place their shins and knees on the padded rest.

In embodiments, the padded rest has a width of at least 60 cm or at least 70 cm. The padded rest can also be adapted in width to meet all circumstances. If a person has slightly more voluminous upper legs, knees spaced further apart from each other can also be placed comfortably on the padded rest.

For far-reaching flexibility, the padded rest can also be configured in one piece. This facilitates the production, mounting, disinfecting or cleaning of the padded rest.

BRIEF DESCRIPTION OF THE DRAWINGS

Further features, details and advantages of the invention will become clear from the wording of the claims and also from the following description of illustrative embodiments with reference to the drawings, in which:

DETAILED DESCRIPTION

Figure 1:
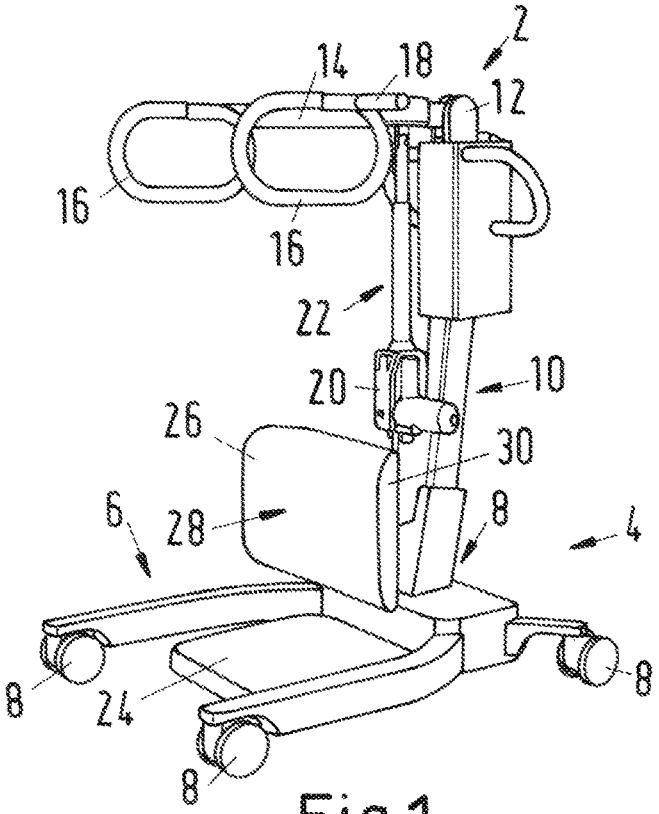
FIG. 1 shows a perspective view of the standing aid according to the disclosure, obliquely from the side.

FIG. 1 shows an example of a standing aid 2 according to the present disclosure.

The standing aid 2 has a frame 4, the latter having a base 6 with four castors 8 which stand on a floor. The castors 8 can be at least partially blocked. A vertical portion 10 of the frame 4 extends substantially vertically upward from the base 6, i.e. in a direction away from the floor. There, a pivot bearing 12 is provided on which a support arm 14 is pivotably mounted. The pivot bearing 12 is designed in such a way that the support arm 14 is movable about a substantially horizontal pivot axis between a lowered and a raised position. The support arm 14 has several handles 16 and 18 allowing a person to hold on. In addition, belts, straps or slings could be applied here.

The standing aid 2 moreover has a drive device 20 which is equipped, for example, with a linear drive 22 coupled to the support arm 14. The drive device 20 is arranged pivotably on the vertical portion 10 of the frame 4, such that its orientation can adapt to the respective position of the support arm 14 during the pivoting of the support arm 14.

Moreover, a foot rest 24 on which a person can place their feet is arranged on the base 6, such that the standing aid 2 cannot accidentally roll away as the person stands up, and instead the person and the standing aid 2 are fixed relative to each other. A padded rest 26, which is configured in one piece for example, is located vertically above the foot rest 24.

The padded rest 26 has a substantially flat structure and extends for example by a width of approximately 70 cm. Moreover, its extent in the vertical direction is chosen such that, for practically all sizes of persons, it is possible to ensure that the shins and knees can be placed on a bearing surface 28 of the padded rest 26.

Figure 1A:
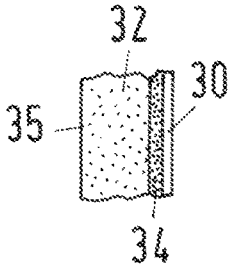
FIG. 1*a* shows a sectional view of a padded rest of the standing aid.

The padded rest 26 additionally has a fixed shell 30 which is arranged opposite the bearing surface 28. The shell 30 serves to secure the padded rest 26 on the frame 4 and to hold a viscoelastic foam 32 which is located in the padded rest 26 and which extends as far as the bearing surface 28. For example, a base layer 34, which has a cold-cure foam, can additionally be arranged between the foam 32 and the fixed shell 30. This prevents a person from hitting directly against the fixed shell 30 if the depth of the foam 32 is fully penetrated (see FIG. 1*a*).

The foam 32 is a viscoelastic foam which has a thickness of at least 6 cm, alternatively of at least 7-13 cm, or alternatively of approximately 10 cm. On account of its viscoelastic properties, it is particularly suitable for the standing aid 2 according to the disclosure. When a person places their feet on the foot rest 24, the shins and the kneecaps are intended to nestle onto the padded rest 26. With gentle contact, and within a short space of time, the viscoelastic foam 32 is able to gradually follow the contour of the shins and of the knees and thus conform ideally to the person in question. However, on account of the viscoelastic properties, the foam 32 is able to apply a sufficient counter-force in the event of more rapid movements or of sudden changes of the mechanical pressure. When the foam 32 therefore adapts to the person in question, there is a very uniform surface contact over the shins and the knees. When the person stands up, the mechanical pressure on the foam 32 changes quite rapidly, such that it is exposed to a temporary, attenuated counter-force. The foam 32 therefore functions as a support bearing and is distinguished by the very uniform pressure across the whole surface contact on the bearing surface 28. Consequently, the load on the person's knees is also barely noticeable.

Therefore, the padded rest 26 does not have to be mechanically adapted to a particular person, and instead, as is shown in FIG. 1, can be provided in a relatively large format and, on account of the viscoelastic properties, can generate sufficient mechanical support with at the same time a low surface load. By virtue of a sufficient width, it is also possible to take account of persons whose upper legs are somewhat more voluminous and in whom the distance between the knees is slightly greater than in other persons. The padded rest 26 could even be designed slightly larger than shown here in FIG. 1, since there would be sufficient space available for this in the vertical direction.

For easier cleaning or disinfecting of the padded rest 26, a protective layer 35 can be provided which completely surrounds the foam 32 and the shell 30. The protective layer 35 can be water-tight and resistant to chemicals, in particular disinfecting agents.

Figure 2:
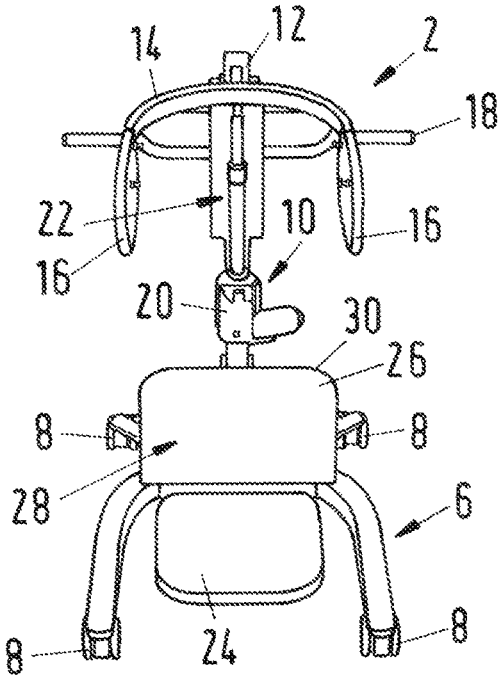
FIG. 2 shows a perspective view of the standing aid, from above.

FIG. 2 shows the standing aid 2 in a view obliquely from the front and from above. It reveals in particular the forms of the different handles 16 and 18 and also the shape of the support arm 14. The support arm 14 has a U-shape, for example, and extends at an uppermost end of the vertical portion 10 over the base 6. A similar U-shape is taken up by the base 6, wherein the foot rest 24 is located in the U-shape of the base 6. It can be seen that the padded rest 26 has a width which corresponds approximately to the width of the support arm 14 and to the spacing of the handles 16. Its width slightly exceeds the width of the foot rest 24 and could be dimensioned more or less at shoulder width.

Figure 3:
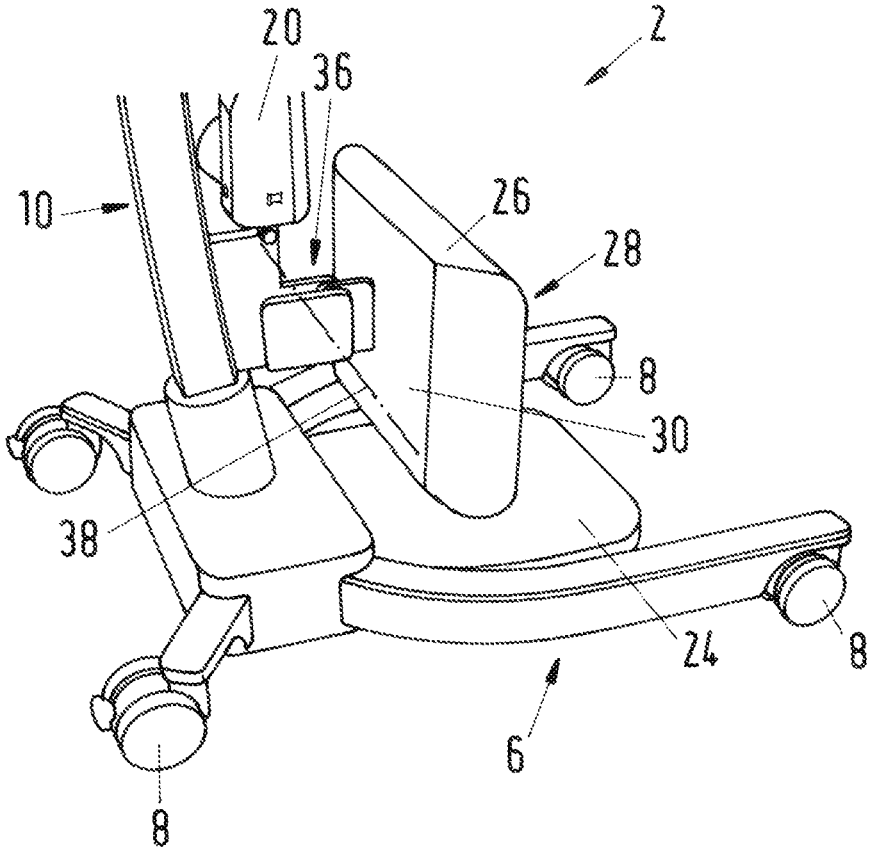
FIG. 3 shows an isolated perspective view of the bottom portion of the disclosed standing aid, directed to the rear side of the padded rest.

A further essential detail is illustrated in FIG. 3, in which the base 6 is shown in a view obliquely from behind. A pivotable bearing 36 is arranged here which allows the padded rest 26 to perform a tilting movement about a horizontal hinge axis 38. The hinge axis 38 runs at approximately half the height of the padded rest 26. As the person stands up, the padded rest 26 is thus allowed to perform a tilting movement about the hinge axis 38. Since, during a standing-up movement from a seated position to a standing position, the orientation of the person's shins and knees changes, the padded rest 26 can follow this movement very easily and in an entirely flexible manner, without losing its temporary shape adaptation to the person.

The bearing 36 can be freely movable. However, it is also conceivable to provide a spring arrangement in the bearing 36, which spring arrangement predefines at least one idle position of the padded rest 26. The spring device could be dimensioned in such a way that nothing opposes a free movement of the padded rest 26, and only a torque about the bearing 36, caused by the inherent weight of the padded rest 26, is compensated.

The invention is not limited to one of the above-described embodiments and instead can be modified in many ways. It will be noted however that a standing aid 2 for helping a person stand up has a frame 4, at least one support arm 14 mounted movably on the frame 4 with a handle 16, 18, and a drive device 20 coupled to the frame 4 and to the at least one support arm 14 in order to move the at least one support arm 14 to a lowered and to a raised position. The standing aid 2 moreover has at least one padded rest 26 for supporting the person during the movement of the at least one support arm 14. According to the invention, the padded rest 26 is made from a viscoelastic foam 32 with a thickness of at least 6 cm and is dimensioned in such a way that the kneecaps of the person standing up at all time bear on the padded rest 26 during the movement of the support arm 14.

All of the features and advantages emerging from the claims, the description and the drawing, including design details, spatial arrangements and method steps, may be essential to the invention both on their own and in a wide variety of combinations.

LIST OF REFERENCE SIGNS

2 standing aid
4 frame
6 base
8 castor
10 vertical portion
12 pivot bearing

14 support arm
16 handle
18 handle
20 drive device
22 linear drive
24 foot rest
26 padded rest
28 bearing surface
30 shell
32 foam
34 base layer
35 protective layer
36 bearing
38 hinge axis

What is claimed is:

1. Standing aid for helping a person stand up, having:

a frame having a base from which a vertical portion of the frame extends vertically upward, at least one support arm movably disposed on the vertical portion of the frame, wherein the at least one support arm has a support handle, a drive device coupled to the frame and to the at least one support arm, wherein the drive device is configured to move the at least one support arm to a lowered position and to a raised position, and at least one padded rest configured to support the entire shins and knees of the person during a movement of the at least one support arm, wherein the at least one padded rest is formed from a viscoelastic foam with a thickness of at least 6 cm and is dimensioned such that the person's entire shins and kneecaps at all times bear on the at least one padded rest during the movement of the at least one support arm, wherein a rear side of the at least one padded rest has a fixed shell on which the viscoelastic foam is arranged, wherein the rear side of the at least one padded rest has a pivotable bearing connected to the frame, wherein the pivotable bearing has at least one horizontal hinge axis, wherein the pivotable bearing is configured to tilt the at least one padded rest about the horizontal hinge axis of the pivotable bearing due to a movement of the person during the movement of the at least one support arm, wherein the at least one padded rest extends over a foot rest of the frame, wherein a base layer made of a cold-cure foam is arranged between the viscoelastic foam and the fixed shell, and wherein the base layer has a thickness corresponding at most to one quarter of the thickness of the viscoelastic foam.

2. Standing aid according to claim 1, wherein the viscoelastic foam has a thickness of 7 to 13 cm.

3. Standing aid according to claim 2, wherein the thickness of the viscoelastic foam is in a range of 9 to 11 cm.

4. Standing aid according to claim 3, wherein the thickness of the viscoelastic foam is 10 cm.

5. Standing aid according to claim 1, wherein the pivotable bearing is arranged substantially centrally on the at least one padded rest.

6. Standing aid according to claim 1, wherein the at least one padded rest has a flexible, water-tight protective layer.

7. Standing aid according to claim 1, wherein the at least one padded rest is configured to extend to a height of at least 65 cm relative to the foot rest.

8. Standing aid according to claim 7, wherein the height is at least 70 cm relative to the foot rest.

9. Standing aid according to claim 1, wherein the at least one padded rest has a width of at least 60 cm.

10. Standing aid according to claim 9, wherein the at least one padded rest has a width of at least 70 cm.

11. Standing aid according to claim 1, wherein the at least one padded rest is in one piece.

12. Standing aid according to claim 1, wherein the thickness of the base layer is at most one eighth of the thickness of the viscoelastic foam.

* * * * *